United States Patent [19]

Baines

[11] Patent Number: 4,874,256

[45] Date of Patent: Oct. 17, 1989

[54] BAG WITH CARRYING HANDLE FOR CONTAINING MERCHANDISE

[75] Inventor: Patrick A. Baines, Charlotte, N.C.

[73] Assignee: Venture Packaging, Inc., Charlotte, N.C.

[21] Appl. No.: 198,102

[22] Filed: May 24, 1988

[51] Int. Cl.[4] ..... B65D 33/06

[52] U.S. Cl. ..... 383/21; 53/413; 383/25; 493/226

[58] Field of Search ..... 383/21, 25, 29; 493/226; 53/413

[56] References Cited

U.S. PATENT DOCUMENTS

| | | | |
|---|---|---|---|
| 1,733,219 | 10/1929 | Duvall | 383/21 |
| 2,693,836 | 11/1954 | Hayes | 383/29 |
| 3,370,630 | 2/1968 | Haugh et al. | 383/21 |
| 4,252,269 | 2/1981 | Peppiatt | 383/21 |
| 4,539,705 | 9/1985 | Baines | 493/226 |
| 4,550,439 | 10/1985 | Peppiatt et al. | 383/21 |
| 4,730,943 | 3/1988 | Johnson | 383/25 |
| 4,781,474 | 11/1988 | Sengewald | 383/29 |

FOREIGN PATENT DOCUMENTS

| | | | |
|---|---|---|---|
| 2155091 | 5/1972 | Fed. Rep. of Germany | 383/29 |
| 1407248 | 6/1965 | France | 383/21 |

*Primary Examiner*—Stephen P. Garbe

*Attorney, Agent, or Firm*—Shefte, Pinckney & Sawyer

[57] ABSTRACT

A bag formed of a flaccid material for receiving and containing merchandise, the bag being formed by a sheet of such material folded along a fold line to provide two juxtaposed or overlapping wall panels having adjacent side edges which are joined to one another. The fold line is tucked inwardly between the wall panels forming top edges along the wall panels and forming a gusset with the overlapping portions of the wall panels. A separate strip of material is folded lengthwise along a fold line and is disposed about the surfaces of the wall panels externally of the gusset with the fold line of the strip extending generally parallel and adjacent to the top edges of the wall panels. The side portions of the strip are joined at each end thereof to the respective adjacent external surface of the wall panel by seals formed in V-shaped patterns defined by lines extending diagonally at substantially a forty-five degree angle between the side edges and the top edges of the wall panels. The strip is formed with a slit at each end which extends a predetermined length along the fold line. The predetermined length of the slit is sufficiently long to permit the side portions of the strip to separate at the ends of the strip and to permit the wall panels to assume an open disposition when the bag is filled, and so that the strip will extend across the end panel in proximity thereto to provide a handle for the bag.

11 Claims, 2 Drawing Sheets

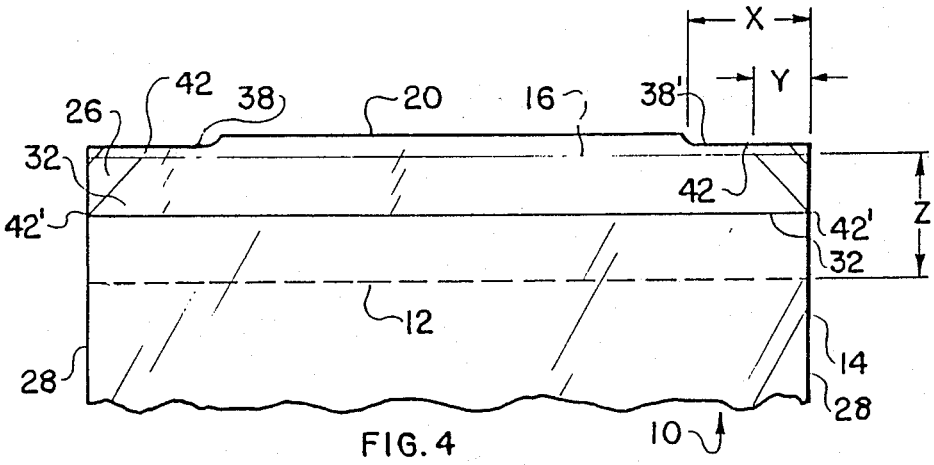
FIG. 4
FIG. 5
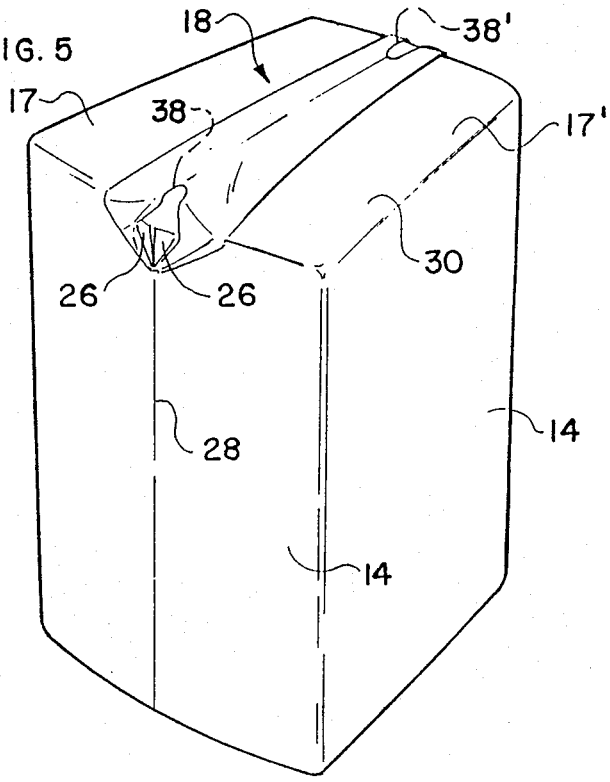

BAG WITH CARRYING HANDLE FOR CONTAINING MERCHANDISE

BACKGROUND OF THE INVENTION

The present invention relates to bags formed of thin flaccid material for containing merchandise and the like, and more particularly to bags of this type with handles to facilitate carrying the bag after it is filled with merchandise.

For customer convenience, manufacturers of various types of merchandise are packaging the merchandise in bags which have handles formed thereon to facilitate picking up the bag and carrying it away. The competition for sales of the merchandise usually packaged in bags of this type makes display of the bag at the point of purchase important. It is desirable that the surface area of the bag be attractive to draw the customer's attention and that the surface area be receptive for advertising copy to inform the customer and promote the purchase decision at the point of purchase. Therefore, it is important that the handle only minimally obstruct the consumer's view of the bag and that it not otherwise interfere with the display of the bag at the point of purchase, yet it should be clearly visible to purchasers so that they will utilize the handle for their convenience. These bags should also be cost-effective to produce and lightweight, and therefore, they are usually made from a thin plastic material, such as polyethylene.

A common type of bag of this nature is a single-walled plastic bag which is constructed very simply by folding a length of material evenly onto itself about a centerline and then sealing together the two opposite side edges, usualy by conventional heat sealing equipment employed during the bag assembly process. The edges opposite the fold are left open to permit the loading of merchandise into the bag. Handles are typically formed in these bags by cutting openings into the top of the side wall panels formed when the length of material was folded onto itself through which the hand may be inserted for carrying the bag. This method presents a simple and cost-effective method of forming a handle, but a drawback is that the strength of the bag is impaired. The plastic material about the handle openings is subject to tearing during carrying if the merchandise loaded into the bag is relatively heavy of if the bag must be carried for an extended period of time. Another type of bag of similar construction with an open top is provided with pull cords made of either fabric or plastic material disposed between layers of the open end of the side walls folded back onto itself at the top thereof with the folded back top edge being heat sealed to the adjacent side wall to form a channel in which the draw cord runs. The draw cord then serves as a handle after it is drawn to close the bag. This exhibits improved strength characteristics in comparison to the previously described bag but has significantly increased production costs and may pose stacking and storing problems because of the bulk of the bunched material when the cord is drawn to close the bag. Additionally, this bag does not have the functional advantages of bags which are sealed completely at the open end to protect the merchandise carried in the bag. Another type of handle arrangement often provided with bags of this construction is to secure separate handle elements of hardened plastic to the side wall panels. This type of handle arrangement also has the disadvantage of increased production cost, and in some cases, may be difficult to stack and store because of the presence of the projecting handles.

Another type of bag construction results in a rectangular shape, which is particularly cost effective to product in that excess bag material is minimized because the bag is intended to conform to the rectangular shape of the particular merchandise packaged therein, such as folded diapers, blankets and the like. The bag also presents a smooth, neat appearance on which advertising copy can most effectively be displayed for customer viewing. In this respect, the bag is also desirable for packaging flowable or particulate merchandise such as peat moss, grass sead and similar items which will cause the bag to assume its rectangular shape when filled. To form this rectangular type bag, it is conventional practice to form one end face of the bag with a gusset that permits such end face to readily assume the desired rectangular configuration. The other, open end of a bag of this type of construction is also sealed across the surface of the merchandise such that the bag loaded with merchandise presents a generally cubic shape. The open end of the bag can also be formed to an excessive length so that it can be twisted into a pigtail to close the bag and serve as a handle for carrying the bag. This arrangement is disadvantageous because the pigtail is bulky, making the bag difficult to stack one upon the other, and the vertically extending pigtail is ergonomically awkward to grasp in comparison to a horizontally extending handle arrangement and has a tendency to slip unless grasped tightly. This problem is exacerbated by the generally thick texture of the plastic material forming the pigtail and by the weight of the bag filled with merchandise. Like the draw cord type bag, the pigtail-type bag does not provide the same product integrity that is usually obtained from bags having a fully sealed end.

In one effort to overcome the disadvantages of pigtail-type bags discussed above, some gusset-type bags have been made with separate handle strips that are secured to the bag during the bag forming process. In one form, the handle is simply a strip of material that extends across the end face or top panel of the bag with both ends being heat sealed or otherwise secured to the opposite side panels of the bag. In another form, the handle includes an integral rectangular attachment strip and a handle portion extending across opposite sides of the rectangular attachment strip so that when the attachment strip is secured, such as by heat sealing, around the entire periphery of the bag adjacent its end face, the handle portion will extend across the end face of the bag.

In both of the foregoing gusset-type bags with handles, the handle strips are somewhat longer than actual width of the end face of the bag so that the handle strips do not lie close across the end face of the bag and therefore may not present a neat tailored appearance when the bags are filled with merchandise and displayed at reatil outlets. More importantly, unless the bag itself is made of a double-ply laminated construction, which is generally quite expensive to produce, it is not feasible to include graphics, advertising, copy and like in the the area at which the handle is actually attached to the bag, and, therefore, there is a significant loss in available space on the bag for such printed material. More specifically, in the double-ply laminated bag construction, the ink for the graphics is sandwiched between the two plys and therefore is not significantly affected by heat sealing the handles directly to the walls of the bag where the graphics appear. However, as indicated above, this double-ply laminated bag construction is relatively expensive to produce, and therefore it is generally used only on production runs where very large numbers of the same bag are to be produced.

On the other hand, when bags are to be produced for the private label market, where production runs consist of a much smaller number of bags for a particular customer, it is not economically feasible to use the double-ply construction, and the graphics are presented directly on the exterior surface of the single-ply bag. In this construction, which is less expensive to produce, handles cannot be attached directly to the exterior surface where graphics appear because the heat sealing of the handles will deface or mar the graphics to an extent that the aesthetics of the bag, and perhaps the message intended to be presented by the graphics, will be adversely affected.

Another disadvantage of the two above-described outside-handle bags is the increased production costs that are required to manipulate the handle material so that it is disposed properly with respect to the bag to which it is to be attached, and to then seal the handle to the bag, all of which is believed to require special equipment.

Finally, in the form of the bag that utilizes a handle extending across a rectangular attachment pull, there is a significant amount of waste resulting from the fact that the polyethylene sheet material from which the handle is cut must have a pattern that results in the rectangular attachment piece and the crossing handle piece, and this pattern necessarily includes portions of the sheet material that are cut out and lost as waste during the handle forming process.

Another known prior art bag is disclosed in U.S. Pat. No. 4,539,705. While this prior art bag and the bag of the present invention are similar in that they are both gusset-type construction bags, the production process of the prior art bag involves inserting the folded handle strip into the gusset of the bag and heat sealing the strip internally to the adjacent overlapping portions of material forming the gusset. The bag of the present invention is simpler and more cost-effective to produce as the folded strip is disposed about the wall panels of the bag, externally to the gusset and heat sealed to the outside surface of the wall panel at greater production speeds than the inside gusset handle.

The present invention provides significant improvements over these conventional bags and is cost-effective to produce. The bag of the present invention includes a single handle which is automatically carried to the top of the bag and extends across centerline of the top panel of the bag formed by the gusset when merchandise is loaded into the bag. The handle therefore is immediately obvious to the customer and can be readily grasped and held for carrying without the difficulties associated with the prior art bags which have large loop handles just discussed. Finally, the bag of the present invention is simple to construct, which adds little to the production costs of the conventional gusset-type bags without handles.

SUMMARY OF THE INVENTION

The bag of the present invention is formed from a sheet of thin flaccid plastic material such as polyethylene, polypropylene, or polyvinyl-chloride which is folded along a fold line upon itself to provide two juxtaposed wall panels having adjacent side edges which are joined to one another. The fold line is tucked inwardly between the wall panels forming top edges along the wall panels and forming a gusset with the overlapping portions fo the wall panels. A separate strip of material is folded lengthwise along a foldline and is disposed about the surfaces of the wall panels externally of the gusset with the fold line of the strip extending generally parallel and adjacent to the top edges of the wall panels with the side portions of the strip on opposite sides of the fold line extending across the wall panels, respectfully, on both sides of the bag. The side portions of the strip are joined at each end thereof to the respective adjacent external surface of the wall panel by seals formed in V-shaped patterns defined by lines extending diagonally between the side and the top edges of the wall panels. The strip is formed with a slit at each end which extends a predetermined length along the fold line. When the bag is filled with merchandise, the wall panels will assume an open disposition on each side of an end panel formed by the gusset. The predetermined length of the slit is sufficiently long to permit the side portions of the strip to separate at the ends of the strip and to permit the wall panels to assume an open disposition when the bag is filled, and so that the strip will extend across the end panel in proximity thereto to provide a handle for the bag. This adjacent disposition of the handle to the end panel obviates the disadvantages associated wtih the prior art bags having looped handles as previously discussed. The flaccid nature of the bag material and the material of the strip forming the handle nevertheless makes insertion of the hand under the handle strip and between it and the end panel quite easy.

Preferably, each of the lines defining the V-shaped seal patterns extend essentially at an angle of forty-five degrees with respect to both the top edge and the side edge of the wall panels, and the length of each slit in the handle strip is at least twice as long as the spacing along the top edge between its intersection with the side edges and the point at which the diagonally extending seal lines intersect such top edge. Also, in the preferred embodiment of the present invention, the length of each slit in the handle strip should not be longer than one-half of the width of the gusset so that the handle will have an appropriate length to extend across the end panel of the bag when it is filled with product.

BRIEF DESCRIPTION OF THE DRAWINGS

FIG. 4 is a plan view of one end portion of a bag embodying the present invention; and FIG. 5 is a perspective view illustrating a bag embodying the present invention and filled with merchandise.

DESCRIPTION OF THE PREFERRED EMBODIMENT

Figure 1:
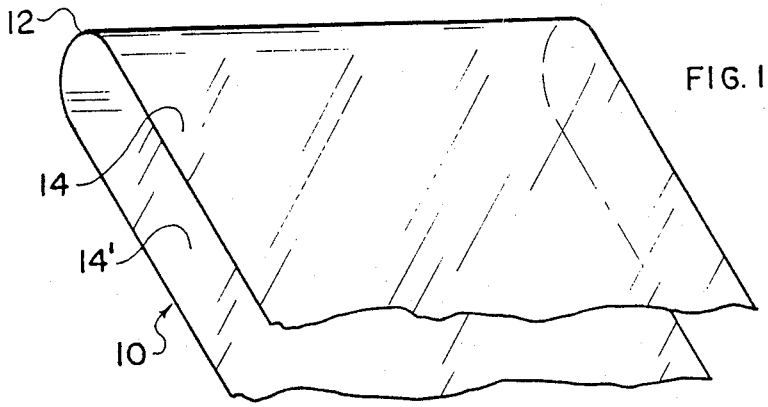
FIGS. 1–3 are perspective views illustrating diagrammatically, in progression, the steps of forming a bag in accordance with the present invention.
Figure 2:
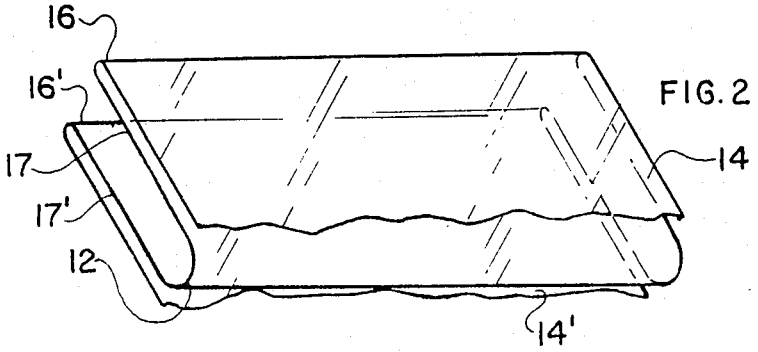
Figure 3:
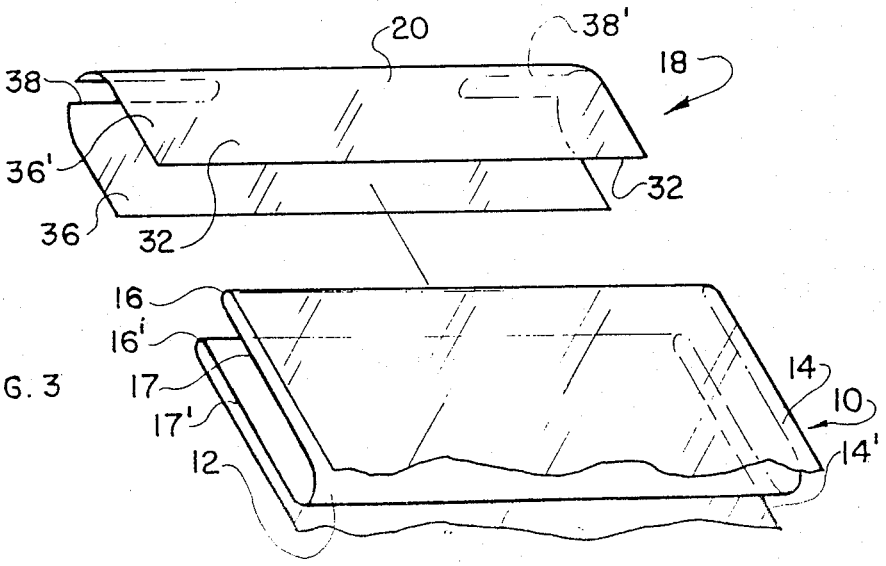

Referring now in greater detail to the accompanying drawing, FIGS. 1–3 illustrate in perspective views the progressive steps used in forming the bag of the present invention. It is to be noted that FIGS. 1-3 are presented in diagrammatic form with the various folds of the material being purposely shown in somewhat exaggerated form for clarity of illustration in understanding such steps.

As best seen in FIG. 1, the method of forming the bag of the present invention begins by taking a sheet of thin, flaccid material 10, which is preferably a thin sheet of polyethylene or a similar heat-sensitive plastic, and folding it across itself along a first fold line 12 whereby two wall panels 14,14' are arranged with the major portions thereof lying in an overlapping or juxtaposed relation with the fold line 12 providing a closed edge and with the other ends of the wall panels 14,14' being unsealed to provide an open bottom edge. Next, as shown in FIG. 2, the fold 12 is tucked inwardly between the juxtaposed wall panels 14,14' along fold lines 16,16' to form gusset walls 17,17', the gusset consisting of the four overlapping layers of the sheet of material 10 extending across the width thereof. A separate strip of material 18, which is also preferably made of polyethylene or the like, is provided, and this strip of material 18 has an extending length that is substantially equal to the width of the gusset walls 17,17' an the wall panels 14,14', and the strip 18 has a width that is at least half the combined length of the gusset wall 17,17'. With this configuration of the strip 18, it may be folded along its longitudinally extending centerline at fold line 20 and about the wall panels 14,14' externally to the gusset as shown in FIGS. 3 and 4 with the fold line 20 being disposed generally adjacent the fold lines 16,16' and extending generally parallel therewith, and with the side portions 36,36' of the strip 18 on opposite sides of the fold line 20 and extending across and externally of the wall panels 14,14' and juxtaposed thereto. The strip 18 has slits 38,38' therein at each of its ends which extend along the fold line 20. As will be described in more detail below, the slits 38,38' have a predetermined length to permit side portions 36,36' of the strip 18 to separate at the ends 32 of the strip and to permit the wall panels 14,14' to assume an open disposition when the bag is filled with merchandise. Once the strip 18 has been properly placed in disposition about the wall panels 14,14' to assume an open disposition when the bag is filled with merchandise. Once the strip 18 has been properly placed in disposition about the wall panels 14,14' as described, the overlapping gusset walls 17,17', the ends of the wall panels 14,14' and the strip 18 are joined together, preferably by conventional heating sealing equipment (not shown). More specifically, the three overlapping layers of plastic material on both sides of the fold line 12 corresponding to a gusset wall 17 or 17', a wall panel 14 or 14' and a side portion 36 or 36' of the strip 18 are respectively bonded together at both ends 32 of the strip 18 by seals formed in V-shaped patterns indicated by the lines 26 in FIGS. 4 and 5, such bonding being obtained preferably by the use of heating elements (not shown) in the same general manner as that described in detail in U.S. Pat. No. 4,539,705. These seal patterns are preferably in the form of heat seal lines extending diagonally across the corner of the strip 18 from the side edge of the wall panels 14,14' to the top edges represented by the fold lines 16,16' at an angle of 45 degrees (45°) with respect to such edges, but such V-shaped seal patterns may also be formed by other variations of heat seal lines disposed to provide an effective seal generally along the pattern defining diagonal lines 26 to obtain the advantages of diagonal seals as explained in greater detail in the aforesaid U.S. Pat. No. 4,539,705. Referring to FIG. 4, the edge of the lines 26 terminate at a point 42 on the top edges 16,16' and at point 42' on the side edges 28 of the bag. To complete the bag, the adjacent side edges of the overlapping wall panels 14,14' are joined together at side edges 28 extending along the length thereof (see FIGS. 4 and 5), preferably by conventional heat-sealing equipment designed for this purpose (not shown).

The completed bag may then be loaded with merchandise through its open end, such merchandise causing the bag to assume a generally rectangular shape defined and limited by the dimensions of the bag. This loading of the bag will, of course, result in the wall panels 14 and 14' assuming an open, tubular configuration as illustrated in FIG. 5 and having a flat end panel 30 at the closed end thereof, such end panel 30 being formed by the previously inwardly tucked gusset walls 17,17' described above. Moreover, the strip 18 will now extend across the end panel 30 and will lie immediately adjacent to the surface of the end panel 30. The open ends of the wall panels 14,14' may then be closed or sealed in any suitable manner to close the bag about the continued merchandise.

As best seen in FIG. 4, each of the slits 38,38' in the handle strip 18 has a length (indicated by the letter "X" in FIG. 4) that is at least twice as long as the spacing along the top edges 16,16', respectively, between their intersection with side edges 28 and the aforesaid point 42 at which the lines 26 intersect the top edges 16,16', such spacing indicated by the letter "Y" in FIG. 4. By virtue of this relationship, side portions 36,36' of the strip 18 will separate as the bag expands to its generally rectangular shape as it is filled with merchandise or products. Also, to assure that handle strip 18 has a proper length to extend across the end panel of the bag when it is filled with product as illustrated in FIG. 5, the length "X" of each slit 38,38' should be no longer than one-half of the total width of the gusset. Since the gusset walls 17,17' are folded within the bag during production (see FIGS. 2 and 3), one-half of the total gusset width is represented by the letter "Z" in FIG. 4, and therefore the length "X" of each slit 38,38' should be no longer than "Z" as illustrated in FIG. 4.

In looking at FIG. 5, it will be noted that the strip 18 now forms a handle extending across the top panel in close proximity thereto to provide a neat appearance, and to avoid the above-described drawbacks associated with known bag handles in the form of extended loops. However, this close proximity of the handle strip 18 to the end panel 30 does not interfere in any significant manner with the ability of a user to readily insert the fingers of the hand between the handle strip 18 and the end panel 30, particularly since the flaccid nature of the material forming the handle strip 18 and the bag itself lends sufficient flexibility to permit such insertion.

When the bag shown in FIG. 5 is carried by its handle strip 18, it will be appreciated that the load imposed by the weight of the merchandise in the bag is borne at the seal lines 26. By forming these seal lines 26 at 45 degree (45°) angles to the side edges 28 and the fold lines 16,16', they will form V-shaped seal line patterns at the sides of the bag as shown in FIG. 5, and these V-shaped seal line patterns will serve to evenly distribute the load of the merchandise along the entire width of the side of the bag. Additionally, it will be noted that the seal lines 26 join the wall panels 14,14', the gusset walls 17,17' and the ends 32 of the handle strip 18 together as one integral unit, whereby the handle strip 18 is secured directly to the wall panels 14,14'.

As compared with conventional bags having two handles that extend along the side walls of the bag until they are pulled upwardly by the user, the bag of the present invention offers at least two significant advantages. First, as best seen in FIG. 5, the handle strip 18 extends directly across the center of the top surface of the bag so that it is readily accessible to the users, and it is immediately apparent to the user that the handle strip 18 is intended for this purpose. This is in contrast to bags having two handles extending along the sides of the bag, as discussed above, since the user may not see the handles, or may use only one is that the load imposed by the weight of the merchandise is not evenly distributed. Secondly, the handles which extend along the side walls of the bag will cover any artwork or graphics presented by the side walls, thereby reducing the available space for such graphics, artwork, or advertising copy. By contrast, the handle strip 18 of the present invention extends cross the center of the top surface of the bag so as not to overlap the side walls or otherwise impair a full viewing of the entire surface of such side walls.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A bag for receiving and containing merchandise and the like, said bag comprising a sheet of flaccid material folded along a fold line to provide two juxtaposed wall panels having adjacent side edges joined to one another, said fold line being tucked inwardly between said juxtaposed wall panels forming top edges along said wall panels and provides overlapping portions of said wall panels thereby forming a gusset consisting of said overlapping portions of said wall panels, a separate strip of material folded along a fold line extending along the length thereof to provide side portions on opposite sides of said fold line, said strip being disposed about said wall panels externally of said gusset with said fold line of said strip extending generally parallel to and adjacent to said top edges of said wall panels with said side portions of said strip extending across portions of said wall panels respectively, seal means joining the side portions of said strip of material at each end thereof to said respective portions of said wall panels at seals formed in a V-shaped pattern defined by lines extending diagonally between said side edges and said top edges of said wall panels, and said strip having a slit therein at each end thereof along said fold line whereby the filling of said bag with merchandise will result in said wall panels assuming an open disposition having an end panel formed by said gusset, said slit having a predetermined length to permit said side portions of said strip to separate at said ends thereof and to permit said wall panels to assume said open disposition when said bag is filled, with said strip extending across said end panel and adjacent thereto to provide a handle for lifting and carrying said bag with the weight of said merchandise being borne at said seals.

2. A bag as defined in claim 1 and characterized further in that said wall panels are rectangular in shape with said top edges between the side edges thereof in perpendicular relation thereto, and in that said patten defining lines extend at an angle of essentially forty-five degrees with respect to both said side edges and said top edges.

3. A bag as defined in claim 1 and further characterized in that each of such pattern defining lines extend generally diagonally from said side edge to said top edges of said wall panels.

4. A bag as defined in claim 3 and further characterized in that the length of the slit at each end of such strip is at least twice as long as the spacing along such top edge of the wall panel from the side edge to the point at which said diagonal pattern defining line intersects said top edges of said wall panels.

5. A bag as defined in claim 4 and fuirther characterized in that said length of the slit at each end of said stirp is no longer than one-half the width of said gusset.

6. A bag as defined in claim 3 and characterized further in that said fold line of said strip is disposed at a predetermined spacing from said top edges of said wall panels.

7. A bag as defined in claim 1 and characterized further in that said sheet of material and said strip of material both consist of a heat sensitive plastic material, and in that said seal means consists of a heat seal formed along said pattern defining lines.

8. A method of forming a bag having a handle therefor, said method including the steps of:

(a) folding a sheet of flaccid material to a disposition at which it forms into juxtaposed wall panels having two side edges, a closed edge formed by said fold, and an open bottom edge;

(b) tucking said closed edge inwardly between said juxtaposed wall panels forming top edges along said wall panels to form a gusset consisting of the overlapping portions of said wall panels;

(c) folding a separate strip of material along a fold line extending along the length of said strip to provide side portions on opposite sides of said fold line;

(d) forming a slit in said strip at each end thereof along sid fold line, said slit having a predetermined length to permit said side portions of said strip to separate at said ends thereof and to permit said wall panels to assume an open disposition when said bag is filled with merchandise;

(e) placing said folded strip of material in disposed relation about said overlapping portions of said wall panels external thereto with said fold line of said strip extending parallel and adjacent to said top edges of said wall panels and with said side portions of said strip extending away from said side edges on the outside of said wall panels in the direction of said inwardly tucked portions of sid wall panels;

(f) joining the side portions of said strip at each end thereof to said respective wall panels externally to said gusset at seals formed in a V-shaped pattern defined by lines extending diagonally between said side edges and said top edges of said wall panels; and (g) joining together the adjacent side edges of said wall panels, whereby the filling of said bag with merchandise will result in said wall panels assuming said open disposition having an end panel formed by said gusset and with said handle strip extending across said end panel and adjacent thereto to provide a handle for lifting and carrying said bag with the weight of said merchandise being borne at said seals.

9. A method of forming a bag as defined in claim 8 and characterized further in that said sheet of material and said strip of material consist of a heat sensitive plastic material, and by the further step of inserting a sheet of insulating material through said slit and between the adjacent overlapping portions of said wall panels forming said gusset, and heat sealing said side portions of said strip of material to said adjacent sheet of material forming said wall panels externally to said gusset with said insulating sheet preventing the adjacent overlapping portions of said wall panels forming said gusset from being sealed to one another.

10. A method of forming a bag as defined in claim 8 and further characterized in that said side edges of said wall panels are parallel, said folding and tucking cause said top edges of said wall panels to be oriented in perpendicular relation to said side edges, and said joining together of said strip side portions with said respective wall panels externally to said gusset includes forming said seals to orient said pattern defining lines at an angle of essentially forth-five degrees with respect to both said side edges and said top edges.

11. A bag as defined in claim 1 and characterized further in that said seals are formed as continuous seal lines extending diagonally between said side edges and said top edges of said wall panels along pattern defining lines.

* * * * *

UNITED STATES PATENT AND TRADEMARK OFFICE

CERTIFICATE OF CORRECTION

PATENT NO. : 4,874,256

DATED : October 17, 1989

INVENTOR(S) : Patrick A. Baines

It is certified that error appears in the above-identified patent and that said Letters Patent is hereby corrected as shown below:

Column 1, Line 34, delete "usualy" and insert therefor -- usually --.

Column 2, Line 13, delete "sead" and insert therefor -- seed --.

Column 2, Line 59, delete "reatil" and insert therefor -- retail --.

Column 4, Line 5, delete "fo" and insert therefor -- of --.

Column 4, Line 6, delete "foldline" and insert therefor -- fold line --.

Column 4, Line 29, delete "wtih" and insert therefor -- with --.

Column 4, Line 62, delete "drawing" and insert therefor -- drawings --.

Column 5, Line 19, delete "an" and insert therefor -- and --.

Column 5, Line 21, delete "wall" and insert therefor -- walls --.

Column 5, Lines 39-41, after "14,14'", delete -- to assume an open disposition when the bag is filled with merchandise. Once the strip 18 has been properly placed in disposition about the wall panels --.

Column 8, Line 10, delete "patten" and insert therefor -- pattern --.

Column 8, Line 24, delete "fuirther" and insert therefor -- further --.

Column 8, Line 25, delete "stirp" and insert therefor -- strip --.

Column 8, Line 51, delete "sid" and insert therefor -- said --.

Column 8, Line 63, delete "sid" and insert therefor -- said --.

UNITED STATES PATENT AND TRADEMARK OFFICE

CERTIFICATE OF CORRECTION

PATENT NO. : 4,874,256

DATED : October 17, 1989

INVENTOR(S) : Patrick A. Baines

It is certified that error appears in the above-identified patent and that said Letters Patent is hereby corrected as shown below:

Column 10, Line 12, delete "forth-five" and insert therefor -- forty-five --.

Column 10, Line 18, after "along" add -- said --.

Signed and Sealed this

Ninth Day of June, 1992

*Attest:*

*Attesting Officer*

DOUGLAS B. COMER

*Acting Commissioner of Patents and Trademarks*